US006619582B1

(12) United States Patent
Jørgensen

(10) Patent No.: US 6,619,582 B1
(45) Date of Patent: Sep. 16, 2003

(54) PAPER ROLL HOLDER

(75) Inventor: Carsten Jørgensen, Niklausen (CH)

(73) Assignee: PI-Design AG, Triengen (CH)

( * ) Notice: Subject to any disclaimer, the term of this patent is extended or adjusted under 35 U.S.C. 154(b) by 6 days.

(21) Appl. No.: 10/009,802

(22) PCT Filed: Jun. 27, 2000

(86) PCT No.: PCT/DK00/00347

§ 371 (c)(1),
(2), (4) Date: Feb. 15, 2002

(87) PCT Pub. No.: WO01/01834

PCT Pub. Date: Jan. 11, 2001

(30) Foreign Application Priority Data

Jun. 30, 1999 (DK) ..... 1999 00947

(51) Int. Cl.[7] ..... B65H 23/06

(52) U.S. Cl. ..... 242/597.7; 242/422.5; D6/521; D6/522

(58) Field of Search ..... 242/599.7, 422.5; D6/521, 522, 523

(56) References Cited

U.S. PATENT DOCUMENTS 4,720,053 A * 1/1988 Vance ..... 242/597.7

5,788,136 A * 8/1998 Othman ..... 242/597.7 X

* cited by examiner

*Primary Examiner*—John Q. Nguyen
(74) *Attorney, Agent, or Firm*—Nath & Associates PLLC; Gary M. Nath

(57) ABSTRACT

By means of a holder for a roll of unwindable material, in particular a holder for paper rolls, preferably for standing a paper roll vertically on a horizontal surface, with a cylindrical holding, rod (1), a base (5) and an essentially known pivotal retaining arrangement for the free end of the paper roll, the object is to provide a holder in which the roll is retained on the holder in a stable manner also when different widths of paper are used, and where the cost of manufacture can be reduced through a simple embodiment and few components. This object is realised by the retaining arrangement (2) being pivotally attached to a detachable cover (3) that moves along the axis of the holding rod and which is equipped with a cylindrical skirt (4) that likewise moves axially along the holding rod, and where the diametrical dimensions of the cover are such that during application the cover is in contact with the end surface of the paper roll currently in use, and covers it at least partially.

6 Claims, 1 Drawing Sheet

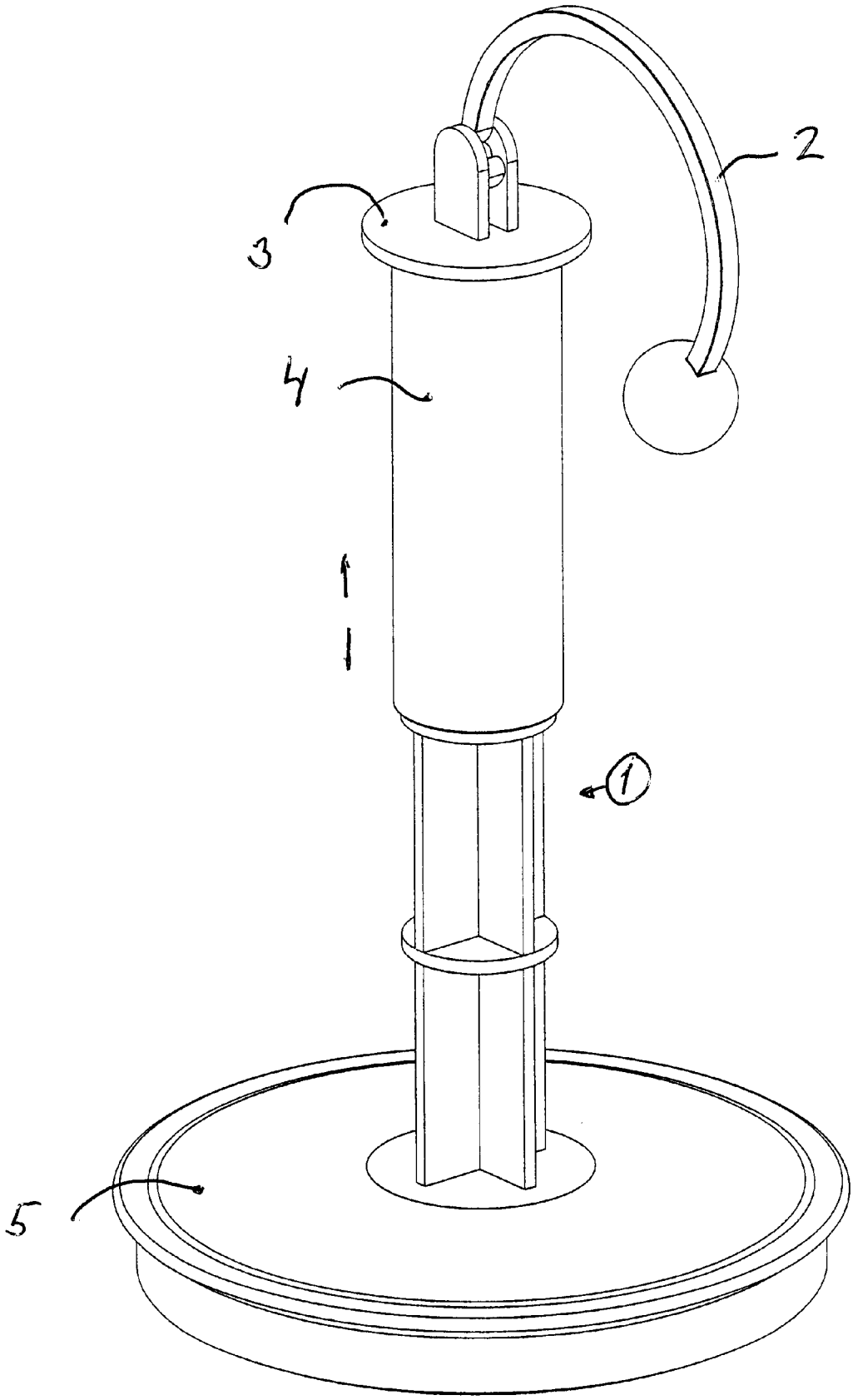
2
3
4
1
5

PAPER ROLL HOLDER

FIELD OF THE INVENTION

The invention relates to a holder for a roll of unwindable material, in particular a holder for paper rolls, preferably for standing a paper roll vertically on a horizontal surface, with a cylindrical holding rod, a foot, and a pivotal retaining arrangement for the free end of the paper roll.

BACKGROUND OF THE INVENTION

Such a holder is known for example from Swedish patent application no. 450083, where a shaft mounted upright on a base plate and a tear-off part starting from the periphery of the base plate are together able to retain the loose end of a paper roll, and where the tear-off part also serves for tear-off of paper from the roll. A drawback of this known holder is that it cannot be used for random-width paper rolls which are wider than the most very common types.

WO patent publication no. 97/28729 specifies a similar movable paper-roll holder where a tightener prevents unintended unwinding of paper. The tightener is acted upon by a force at right angles to the vertical holder shaft so that the tightener exerts a pressure against the paper roll. This force is engendered by a cord pull, a pulley and a counterweight. The drawback of this construction is that it is elaborate and therefore costly. Furthermore, the roll holder can only function when placed on a horizontal surface, so that the counterweight can move axially under the influence of gravitational acceleration and thereby exert a pull on the cord.

U.S. Pat. No. 4.792,102 specifies a similar paper-roll holder, comprising however both an upright shaft for the roll and a guiding means for the brake cover, which by virtue of suitable drilled holes is able to slide on the shaft and the guiding means. This embodiment is elaborate and costly to manufacture, as it employs both machined components and components with drilled holes of varying diameters. Also for this roll holder, application is limited to holders standing on a horizontal surface, as the gravitational acceleration must in this case too act upon the brake cover in an axial direction.

In addition, German patent publication no. 36 13 988 specifies guidance of the cover with a cylindrical cover holder which can be moved axially within a shaft formed as a hollow cylinder, the hollow shaft containing locking means for retaining the cover holder in different axial positions. This roll holder is admittedly suited to being lifted from a worktop by only one hand during usage, but it is not provided with means for braking the rotation of the paper roll, and also for this roll holder application is limited to holders standing on a horizontal surface, as the gravitational acceleration must in this case too act upon the cover and the cover holder in an axial direction.

SUMMARY OF THE INVENTION

The object of the invention is to provide a holder for a roll of unwindable material, in particular a holder for paper rolls, where the roll is retained on the holder in a stable manner also when different widths of paper are used, and where the cost of manufacture can be reduced through a simple embodiment and few components.

The object is realised according to the present invention by the retaining arrangement being pivotally attached to a detachable cover that moves along the axis of the holding rod, and which is equipped with a cylindrical skirt that likewise moves axially along the holding rod, where the holding rod and the skirt have interrelating locking means, and where the diametrical dimensions of the cover are such that during application the cover is in contact with the end surface of the paper roll currently in use, and covers it at least partially. With such an embodiment a roll holder is provided which, with the retaining arrangement, becomes applicable for all common widths of kitchen roll. Furthermore, the application is not limited to horizontal worktops, but extends for example to use at sea aboard a sailing vessel.

In an advantageous embodiment the interrelating locking means of the holding rod and skirt may are releasable when the paper roll is changed. In this way, possibility is provided for lifting of the roll holder with only one hand, thus making it easy to use.

For application of the roll holder on non-horizontal surfaces it is advantageous for the pivot movement of the retaining arrangement to take place against the action of a spring. In this way, reliable and continuous retention is achieved of the loose end of the web, regardless of the orientation of the holder.

It is advantageous for the holding rod to have a cross-section bounded by a circular envelope, as the locking of the cover by the skirt can be accomplished by turning both in relation to each other, as with a bayonet socket.

With a view to producing a locking between holding rod and cover skirt it may be advantageous for the rod or parts thereof to have a cross-section bounded by an elliptical envelope.

Further embodiments are stated in the dependent claims.

BRIEF DESCRIPTION OF THE DRAWING

The embodiment is given greater clarification below with reference to the drawing, which shows:

A perspective representation of a roll holder, in accordance with the invention, arranged for table use.

DETAILED DESCRIPTION OF THE PREFERRED EMBODIMENT

According to the invention the roll holder consists of a base (5), which supports on its top surface a perpendicular holding rod (1) composed in the present embodiment of two surfaces that are at right angles to each other and that form a cross at their cross-section. Surfaces parallel with the surface of the base are mounted at suitable intervals, these serving to brace the two surfaces that are at right angles to each other and whose intersection forms the longitudinal axis of the holding rod. The holding rod is normally to be terminated by a bracing surface.

On top of the holding rod can be seen a cover (3) with a skirt (4), which extends some way down the rod. It is thereby ensured that the paper-roll holder can be used for paper rolls of varying width of web. To the top of the cover is attached a retaining arrangement (2), which in this embodiment consists of a curved hoop which ends in a ball and which is pivotally mounted around a horizontal axis.

The skirt (4) has an internal diameter which, in the embodiment shown, corresponds to the diameter of the holding rod that has a cross-section bounded by a circular envelope. The external diameter corresponds to the internal diameter plus the thickness of the wall. The skirt is in this embodiment constructed as a cylinder capable of accommodating the holding rod like a piston.

The skirt can be locked to the holding rod either by locking means (not shown) or merely by tight-fitting. This will ensure that users of the paper roll are able to handle the roll holder with one hand as the hoop (2) can be used as a handle.

In a advantageous embodiment it is suggested that the interrelating locking means of the holding rod and the skirt are releaseable, when changing the paper roll.

With the cylindrical embodiment of the holding rod the skirt is in principle freely rotatable about the rod. If the cover (3) is also to be used as a brake for the paper roll, it is suggested that the holding rod or parts thereof have a cross-section bounded by an elliptical envelope, and that the skirt have a corresponding cross-section. Possibility of free rotation will thereby be prevented for the skirt, and thus also for the cover, which can thereby act as a brake for the paper roll. In such a case, tight-fitting between holding rod and skirt will be a suitable means of locking the skirt, but by providing different cross-sections, suitably spaced locking means can be provided so that users of the paper roll can also in this case handle the roll holder with one hand.

According to the present invention the roll holder exerts by means of the retaining arrangement (2) a radial pressure which is oriented inwards towards the center of the paper roll, whereby the latter cannot be unwound unintentionally. For applications of the roll holder other than normal household purposes the radial pressure can be retained by the pivotal movement of the retaining arrangement taking place against the action of a spring (not shown), which thereby maintains the radial, inward-oriented pressure. This can take place, for example, aboard a sailing vessel where a worktop is not always horizontal.

What is claimed is:

1. A holder for a roll of unwindable material, in particular a holder for paper rolls, preferably for standing a paper roll vertically on a horizontal surface, with a cylindrical holding rod (1), a base (5) and an essentially known pivotal retaining arrangement for the free end of the paper roll, characterised in that the retaining arrangement (2) is pivotally attached to a detachable cover (3) that moves along the axis of the holding rod and which is equipped with a cylindrical skirt (4) that likewise moves axially along the holding rod, where the holding rod (1) and the skirt (4) have interrelating locking means, and where the diametrical dimensions of the cover are such that during application the cover is in contact with the end surface of the paper roll currently in use, and covers it at least partially.

2. A holder for a roll in accordance with claim 1, characterised in that the interrelating locking means of the holding rod (1) and the skirt (4) are releaseable when the paper roll is changed.

3. A holder for a roll in accordance with claim 1, characterised in that the pivotal movement of the retaining arrangement (2) takes place against the action of a spring.

4. A holder for a roll in accordance with claim 1, characterised in that the holding rod (1) has a cross-section bounded by a circular envelope.

5. A holder for a roll in accordance with claim 1, characterised in that the holding rod (1) or parts thereof have a cross-section bounded by an elliptical envelope.

6. A holder for a roll in accordance with claim 1, characterised in that the skirt (4) or internal parts thereof have a cross-section bounded by an elliptical envelope.

* * * * *